United States Patent [19]

Migowski

[11] Patent Number: 4,543,072

[45] Date of Patent: Sep. 24, 1985

[54] TOY WITH PARACHUTE

[76] Inventor: Günter Migowski, Rothschild-Allee 61, 6000 Frankfurt, Fed. Rep. of Germany, 6000

[21] Appl. No.: 396,901

[22] PCT Filed: Nov. 11, 1981

[86] PCT No.: PCT/EP81/00178

§ 371 Date: Jul. 7, 1982

§ 102(e) Date: Jul. 7, 1982

[87] PCT Pub. No.: WO82/01660

PCT Pub. Date: May 27, 1982

[30] Foreign Application Priority Data

Nov. 12, 1980 [DE] Fed. Rep. of Germany ..... 3042534
Nov. 12, 1980 [DE] Fed. Rep. of Germany ... 8030125[U]

[51] Int. Cl.[4] ..... A63H 33/20
[52] U.S. Cl. ..... 446/54
[58] Field of Search ..... 46/86 R, 86 A, 86 B, 46/86 C, 74 R, 74 A, 74 B, 74 C; 244/155 R, 138 R; 446/54, 49, 51, 52

[56] References Cited

U.S. PATENT DOCUMENTS

| | | | |
|---|---|---|---|
| 1,579,531 | 4/1926 | Hempel | 46/86 R |
| 1,649,374 | 11/1927 | Zundel et al. | 46/86 A |
| 1,835,717 | 12/1931 | Moore | 46/86 R |
| 2,559,458 | 7/1951 | Orr | 46/86 A |
| 3,006,109 | 10/1961 | Boese | 46/86 B X |
| 3,088,701 | 5/1963 | Fricke | 46/86 R |
| 3,218,755 | 11/1965 | Quercetti | 46/74 B |
| 3,375,606 | 4/1968 | Francis | 46/86 R |
| 3,432,962 | 3/1969 | Boese . | |
| 3,949,520 | 4/1976 | Lebensfeld | 46/86 R |

FOREIGN PATENT DOCUMENTS

| | | | |
|---|---|---|---|
| 816262 | 10/1937 | France | 46/86 |
| 1186740 | 3/1957 | France | 46/86 R |
| 363444 | 10/1938 | Italy | 46/86 |
| 528425 | 6/1955 | Italy | 46/86 C |

*Primary Examiner*—F. Barry Shay
*Attorney, Agent, or Firm*—Bucknam and Archer

[57] ABSTRACT

The toy with parachute has two arms (26) forming a grip, hinged to a head (2) and on which acts a spring (3) to cause the spacing of the arms. At the lower end of each arm there is hinged a large panel (28) on which acts the air pressure and to which are fixed the ties (64) of the parachute. The panels have extensions (29) extending upwardly and engaging, in the closed position of the grip, with a corresponding portion (24*a*) of the arms. The head is carried by a support above the grip. To use the toy, the parachute is arranged inside the grip maintained in a closed position. Then the toy is thrown in the air. The air pressure acting on the panels prevents the opening of the grip or clip by the spring until the highest point of the trajectory is reached. Then the clip opens due to the action of the spring and the parachute opens out by the spacing of the arms and of the panels.

2 Claims, 17 Drawing Figures

B – B

TOY WITH PARACHUTE

The invention relates to a toy with parachute. Such a toy comprises a receiving and a holding device to which a parachute is secured and in which the parachute can be accommodated. The toy with parachute is thrown up into the air or is catapulted by means of a launching device in order to release the parachute in the area of the highest point of the trajectory and to hover down to the ground.

A device known in the prior art comprises a toy shaped like a rocket to which a parachute is secured. The value of said device as a toy is not so great since the parachute does not open automatically at the desired moment.

It is an object of the invention not to leave it to chance as to when the parachute is released, but to develop a toy with parachute where the parachute is released reliably and automatically and opens immediately.

According to the invention, this problem is solved in that the toy has two arms forming a grip hinged to the upper end and having a parachute arranged between said arms; a spring which causes said arms in the area of the grip hinge to space apart; two large panels on which air pressure acts and which are connected at the lower end to the arms, which panels, when moved by air, exert a power on the grip arms counteracting the spring; and a head portion fixed above the grip hinge.

This structure guarantees that the grip arms of the toy according to the invention forming the holding device for the parachute remain closed when the toy is thrown up - normally to a height of about 6 to 12 m -, since the air pressure exerted on the large panels exceeds the opening force of the spring. When, however, the toy has reached the apex of its trajectory, the pressure on said panels reduces rapidly so that the spring arranged in the area of the grip hinge opens the parachute grip. About at the same time, the head secured before the grip hinge causes the turning of the toy for about 180°. Due to the spacing of the arms the parachute opens out automatically and the toy will hover down to the ground according to its purpose. The panels may rigidly be connected with the grip arms and may be used as a handle for the toy with parachute. The head before the hinge which may, for example, be a rubber ball moves the center of gravity of the toy to the front and cushions the impact of the toy on the ground. The spring provided in the area of the hinge is adapted to hold the head in the intended position.

It is advantageous that when the panels are hinged to the grip arms and are provided each with an upwardly extending lever and hooking means which engage when the arms are closed and perform a closing moment which is smaller than the moment of the spring acting in opening direction. In the portions of the panels covering the lower section of the grip arms a recess may be provided, and a launching hook for the toy may be fixed in the area of the grip hinge. A toy with parachute having such a configuration can be launched by means of a launching device so that the height reached by said toy is considerably great. The toy is held through the recesses in the panels in the lower portion of the grip arms which are a reinforced handle. When the handle is flat, no recesses are required. Due to the panels provided as closing lever a higher closing force is reached by transmission. Therefore, a stronger opening spring can be provided at the grip hinge by which the opening of the parachute at the apex of the trajectory is effected still more rapidly.

It may be another advantage that the grip arms are hinged by two eyes to a headrest and that the arms can be spaced by two springs each secured to the headrest and to the grip arms.

The grip arms define an elongated cavity in which the parachute is secured by eyes and held therein. One arm may be formed as an elongated flat bowl and the other arm may be rounded, too, or flat and presses the parachute into the counter-arm.

It may also be an advantage that the parachute may be received in a space between the panels to which it is secured by ribbons up to the midpoint. It is also recommended that a receiving chamber be provided for the parachute between the grip arms. The arms may be hinged by eyes to a connecting portion, while the receiving chamber is also hinged to said connecting portion.

The value of the device as a toy may be increased when the arms are elongated like scissors beyond the grip hinge, the elongated portions defining a chamber. In said chamber, either the parachute or another object may be accommodated which is released when the grip arms and the elongated portions are opened.

Each panel may be provided suitably with at least one additional panel. The forces closing the parachute grip or clip can be further increased thereby.

The opening of the parachute according to the invention at the desired moment is guaranteed. The parachute which is secured by its cords to the lower end of the grip arms or of the panels, is placed into the space provided between said arms or said panels, whereupon the grip is compressed and thrown up or catapulted. During the upward movement the air pressure acting upon the panels does not allow the grip to open, the spring device being adjusted accordingly. The grip arms open only in the end range of the upward movement and release the parachute. By hooking the levers at the hinged panels a power transmission is reached for the panel at the rear arm portion at the beginning of the opening procedure.

Further features, advantages and details of the invention become evident from the following specification of some preferred embodiments.

FIGS. 1 through 1*d* respectively show two views and three sectional views of an embodiment of the toy with parachute according to the invention; the sectional views showing three possible cross sectional forms of a grip arm;

FIGS. 2 and 2*a* respectively show two views of a grip arm of a different embodiment with a hinged panel;

FIGS. 3 and 3*a* respectively show two views of another embodiment where two joints are hinged to a head support;

Figure 1:
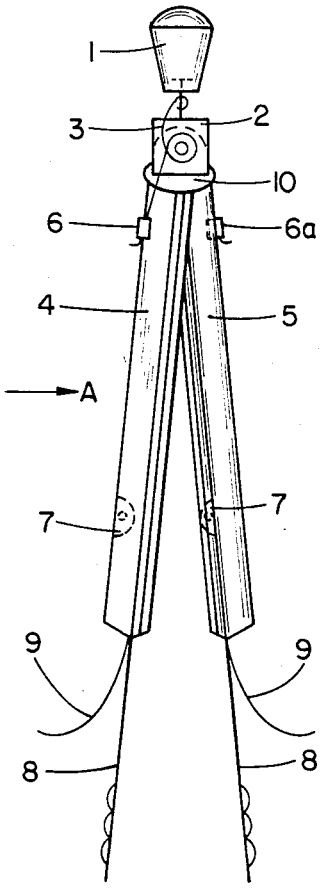
Figure 1A:
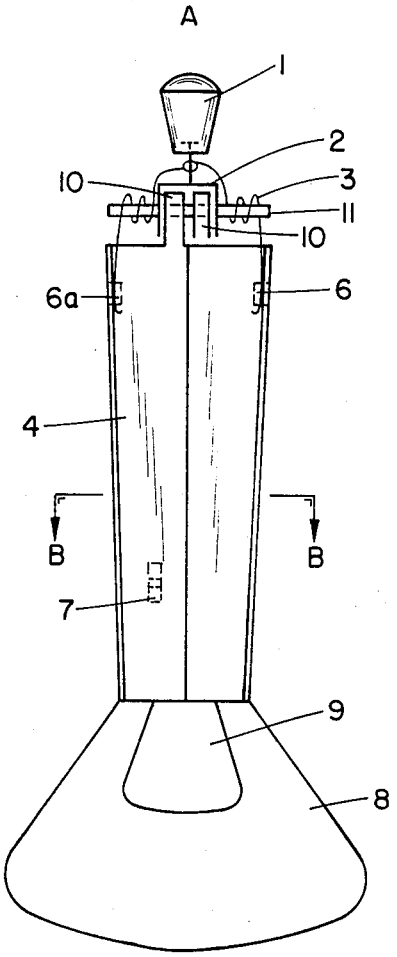
Figure 1B:
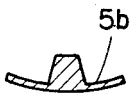
Figure 1C:
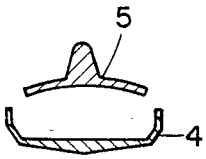
Figure 1D:
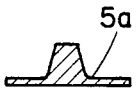

FIG. 1 illustrates a toy with parachute comprising a head 1 preferably made of rubber and secured to a head support 2 holding the head in a central position. Two grip arms 4 and 5 are interconnected by means of eyes 10 at a hinge 11; and a spring 3 which is connected to the grip arms at 6 and 6*a* causes the spacing of the arms. The grip arm 4 has a concave shape, while the cross section of the grip arm 5 is either flat, concave or convex as shown respectively in FIGS. 1*d*, 1*b* and 1*c*. Between the grip arms a parachute can be accommodated having cords which are provided at eyes 7 in the lower portion of the grip arms 4 and 5. The grip arms 4 and 5 are connected to panels 8 on which the air pressure acts, the lower end of which is rigidly fastened to said arms and the end portion of which is provided with a reinforced handle. Additional panels 9 are connected to the panels 8 and increase the clamping force counteracting the spring force upon the flight of the toy with parachute through the air. The spring 3 may be an elastic ribbon or two elastic rings which is (are) provided at the head support and at each one of the arms.

Figure 2:
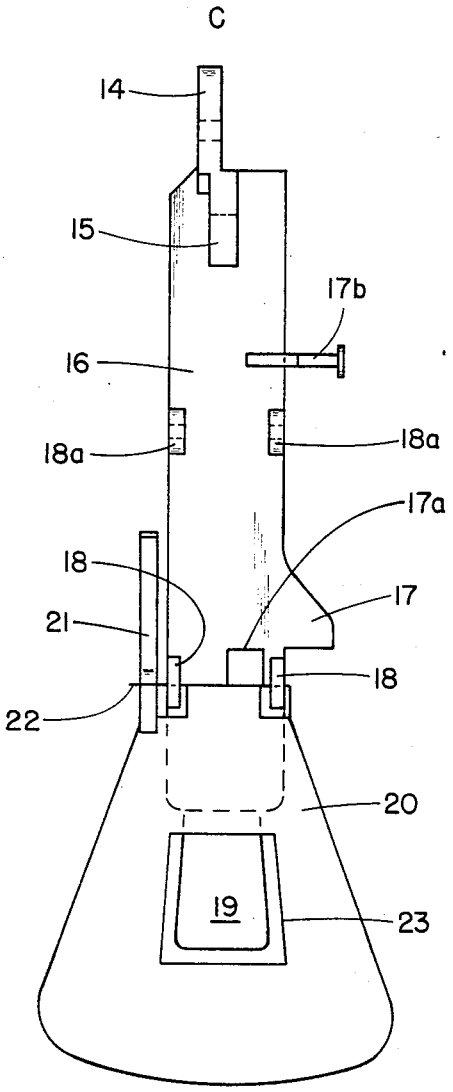
Figure 2A:
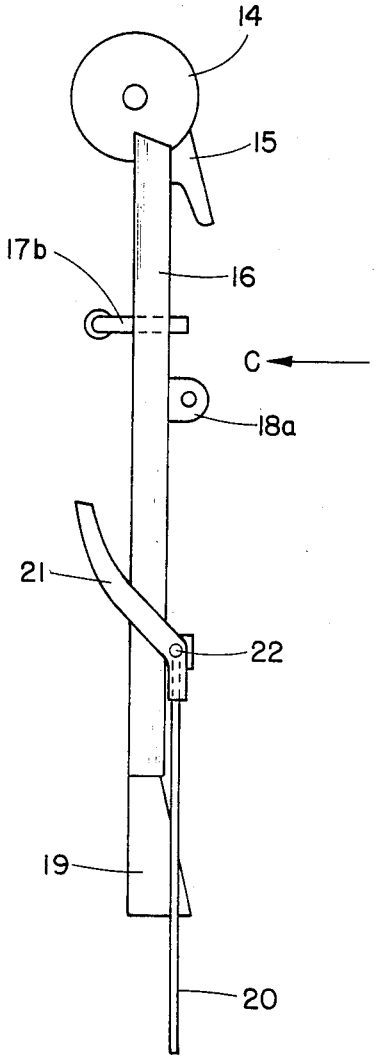

FIG. 2 illustrates another embodiment according to the invention showing that the grip arms 16 are hinged by eyes 14. Each panel 20 is connected to the arms 16 by a hinge 22 or 18*a* and is provided with an upwardly directed lever extension 21 and with hooks 17, 17*a* or 17*b* such that the lever extension of each panel engages the hooking edge of the other grip arm when the grip arms are closed, whereby a closing force for the grip is caused. A launching hook 15 is fixed to a grip arm in the vicinity of the upper grip hinge so that the toy with parachute can be catapulted by a launching device like by an elastic ribbon, and the toy is held through recesses 23 in the panels 20 at the lower end of the handle of the grip arms.

Figure 3:
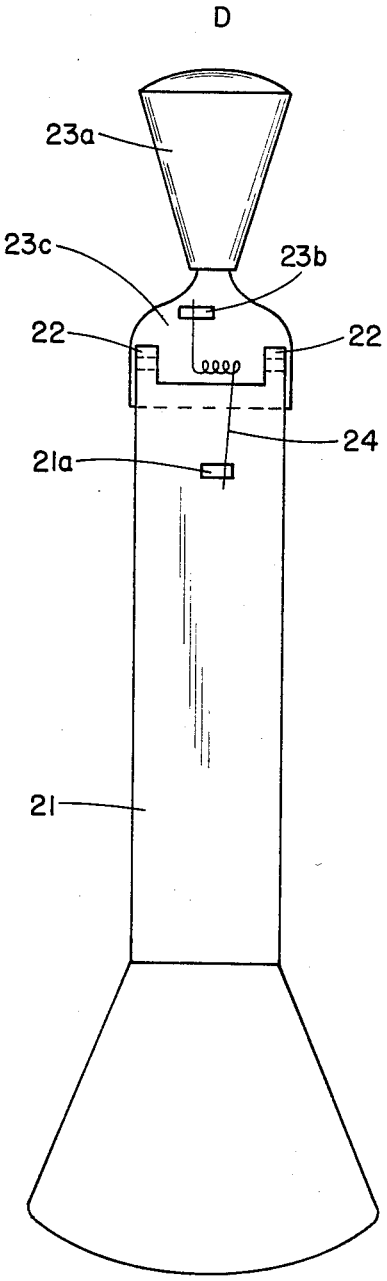
Figure 3A:
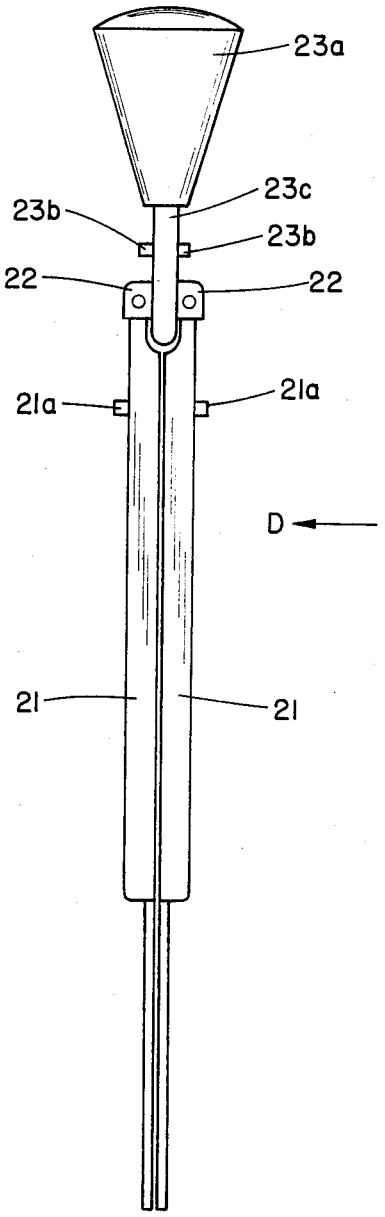

FIG. 3 illustrates another embodiment of the invention wherein the grip arms 21 are hinged by eyes 22 to a head support 23*c*; two springs 24 fixed at 21*a* to the grip arms and at 23*b* to the head support 23*c*, cause the grip arms to space. The head support 23*c* holds the head portion 23*a* in its appropriate position.

Figure 4:
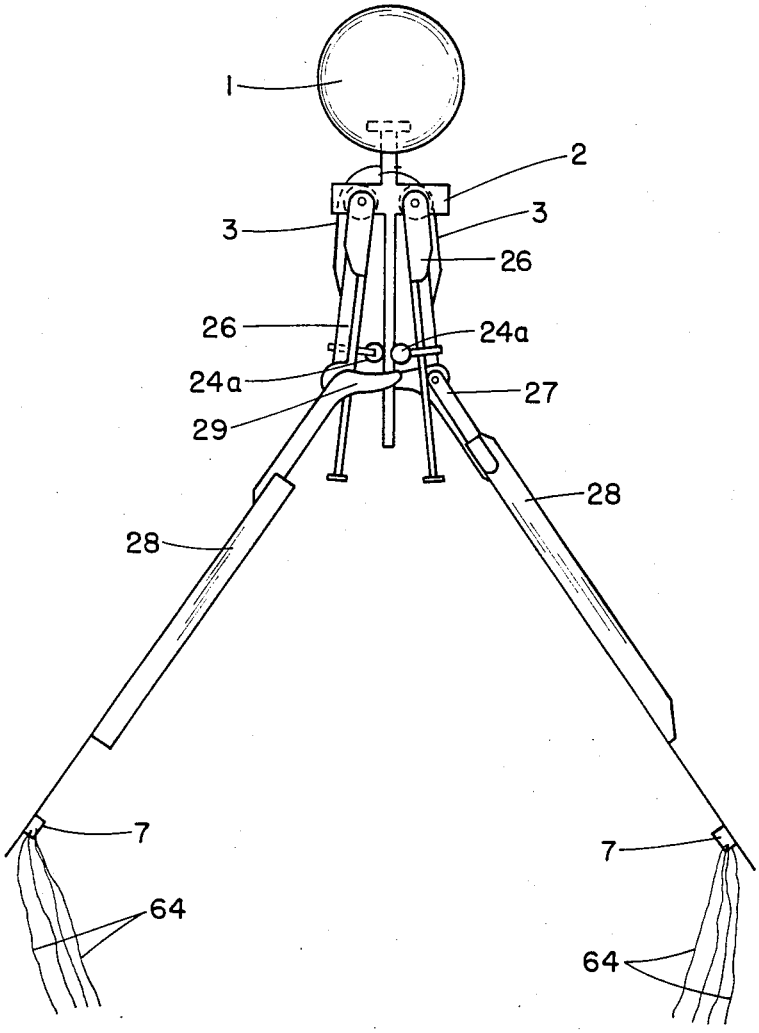
FIG. 4 shows two views of another embodiment according to the invention.
Figure 4A:
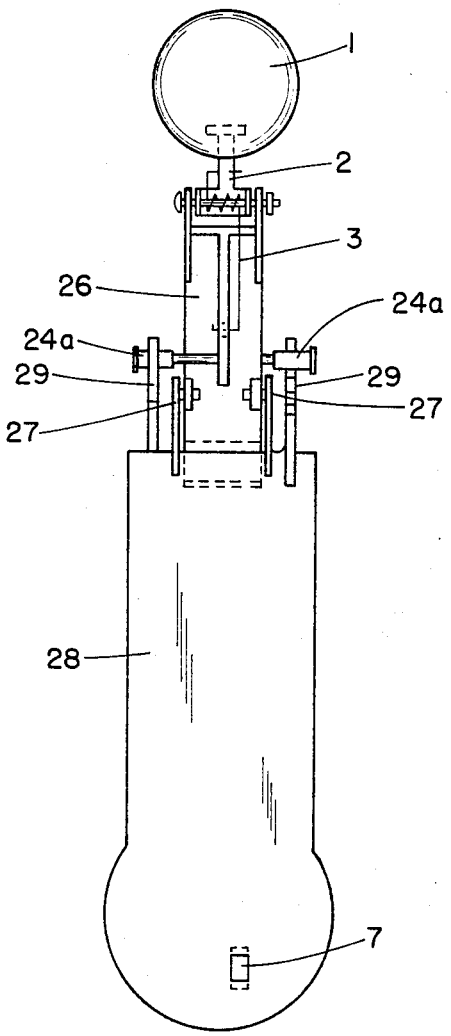

FIG. 4 illustrates another preferred embodiment of the invention. Each grip arm 26 is hinged to the head support 2 by a hinge while elongated panels 28 are connected thereto by hinges 27 in the lower end portion. Lever extensions 29 at the panels 28 embrace attachments 24*a* at the opposing grip arms when the grips are closed whereby an additional closing force is caused. At the lower end portions of the panels holding cords 64 of the parachute are secured to inwardly projecting hooks 7*a*, whereby the opening of the parachute is facilitated when the grip device opens. The lower end portion of the panels is circular and serves, at the same time, as a handle for the toy with parachute.

Figure 5:
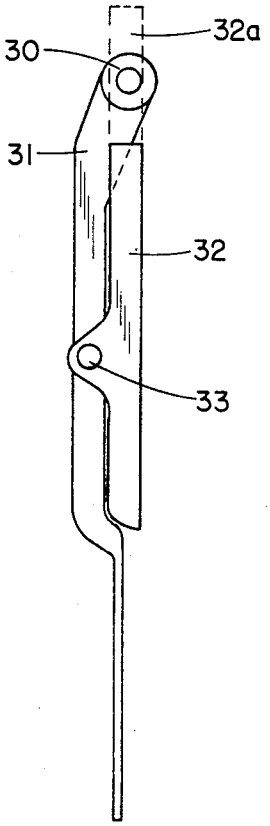
FIGS. 5 and 6 show further embodiments with a parachute chamber.
Figure 6:
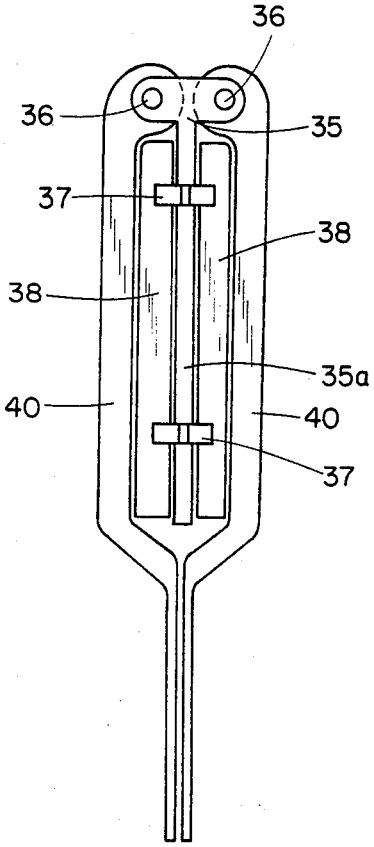

FIG. 5 illustrates a further embodiment of the invention wherein the parachute is accommodated in a chamber 32; either part of said chamber is connected by a hinge 33 to the grip arms 31 which are hinged by eyes 30. FIG. 6 illustrates an embodiment wherein the chamber parts 38 for the parachute are hinged to a member 35 to which the grip arms 40 are connected by two eyes 36.

Figure 7:
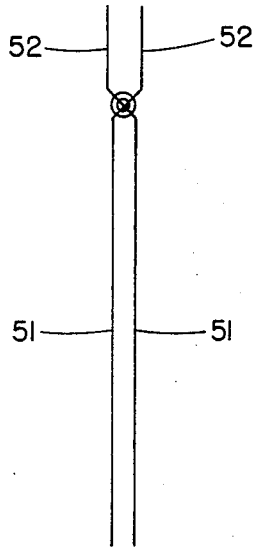
FIGS. 7 and 8 illustrate embodiments having grip arms extending like scissors.
Figure 8:
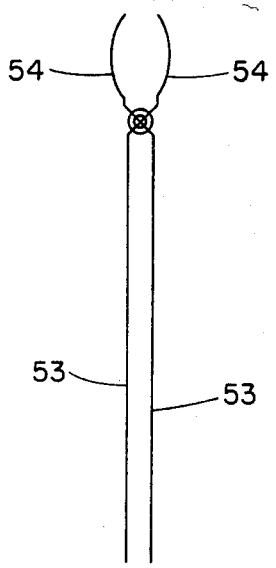
Figure 9:
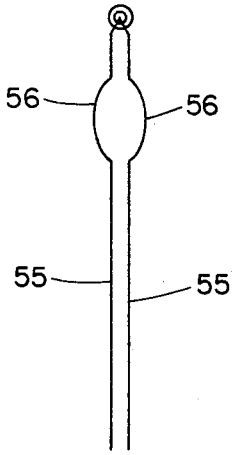
FIG. 9 shows an embodiment with a parachute chamber provided transversely to the grip arms.
Figure 10:
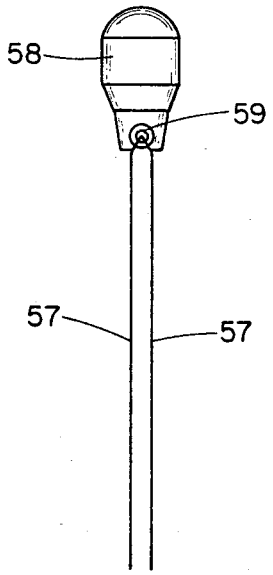
FIG. 10 shows an embodiment with a head container for the parachute, the grip arms being hinged to said container.

FIGS. 7 and 8 illustrate two embodiments with grip arms extending like scissors beyond their hinge, the elongated portions 52 and 54 defining a reception chamber which opens together with the scissor arrangement. The parachute may be accommodated in said chamber or another object by which the value of the toy as a game is increased. FIG. 9 illustrates a parachute grip arrangement comprising a transversely arranged parachute chamber 56. In FIG. 10 there is provided a container head 58 for the parachute which is connected to the grip arms before the grip hinge.

What is claimed is:

1. A toy with parachute, comprising two grip arms (16) hinged at their upper end, between which arms a parachute is arranged, a spring means mounted to said toy at said upper end and acting on the grip arms in the area of the arm hinge to open the same, two large panels (20) on which the air pressure acts connected at the lower end to the grip arms, which panels are attached to said respective arms so that they, when the toy is moved through air, exert a power on the grip arms counteracting the spring means, and which panels (20) are hinged to the grip arms (16) and are each provided with an upwardly extending lever (21) and hooking means (17, 17*a*, 17*b*), the lever of each panel engaging the hooking means of the other only when the grip arms are closed and exerting a closing moment which is smaller than the moment of the spring acting in opening direction, the grip arms (16) defining an elongated cavity in which the parachute is secured to eyes and in which the parachute is accommodated.

2. A toy with parachute according to claim 1, wherein in the area of each panel (20) covering the lower end section (19) of the grip arms (16) a recess (23) is provided, and that in the area of the grip hinge a launching hook (15) for the toy is secured.

* * * * *